US007360254B2

(12) United States Patent
Lin et al.

(10) Patent No.: US 7,360,254 B2
(45) Date of Patent: Apr. 22, 2008

(54) BASEBALL GLOVE HAVING FINGER-LIMITING RIB

(75) Inventors: Kuan-Ming Lin, Kaohsiung (TW); Tai-Ming Chung, Kaohsiung (TW)

(73) Assignee: Taiwan Sakurai Mfg. Co., Ltd., Kaohsiung Export Processing Zone (TW)

( * ) Notice: Subject to any disclaimer, the term of this patent is extended or adjusted under 35 U.S.C. 154(b) by 0 days.

(21) Appl. No.: 11/639,644

(22) Filed: Dec. 14, 2006

(65) Prior Publication Data

US 2008/0060103 A1 Mar. 13, 2008

(30) Foreign Application Priority Data

Aug. 28, 2006 (TW) ..... 95215237 U

(51) Int. Cl.
*A63B 71/14* (2006.01)

(52) U.S. Cl. ..... 2/19; 2/16; 2/21; 2/161.1; 2/163

(58) Field of Classification Search ..... 2/19, 2/16, 21, 161.1, 163
See application file for complete search history.

(56) References Cited

U.S. PATENT DOCUMENTS 3,721,996 A * 3/1973 Nadorf ..... 2/19
5,031,239 A * 7/1991 Panichello et al. ..... 2/19
5,075,899 A * 12/1991 Funahashi et al. ..... 2/19
2005/0268366 A1* 12/2005 Anderson ..... 2/19

* cited by examiner

*Primary Examiner*—Gary L. Welch
*Assistant Examiner*—Alissa J Tompkins
(74) *Attorney, Agent, or Firm*—Townsend and Townsend and Crew, LLP

(57) ABSTRACT

A baseball glove includes a glove body having palm and back side panels which are interconnected to form a hand-receiving pocket that includes finger sections. The back side panel has a through hole below one of the finger sections, and a lacing provided along a periphery of the through hole. The through hole is adapted for extension of a player's index finger therethrough so as to dispose the index finger out of the glove body. A finger-limiting rib unit projects from the back side panel, and surrounds the lacing in a spaced apart relationship. The finger-limiting rib unit has a limiting portion disposed above the lacing and adapted to prevent the player's index finger from slipping on the back side panel.

7 Claims, 5 Drawing Sheets

BASEBALL GLOVE HAVING FINGER-LIMITING RIB

CROSS-REFERENCE TO RELATED APPLICATION

This application claims priority of Taiwanese Application No. 095215237, filed on Aug. 28, 2006.

BACKGROUND OF THE INVENTION

1. Field of the Invention

The invention relates to a glove, more particularly to a baseball or softball glove.

2. Description of the Related Art

Referring to FIG. 1, a conventional baseball glove 1 is made of a leather material, and has a glove body 10 including a palm side panel (not shown), and a back side panel 11 opposite to and interconnected with the palm side panel to form a hand-receiving chamber (not visible). The hand-receiving chamber includes an index finger pocket 13. The back side panel 11 is formed with a through hole 12 that communicates with the hand-receiving chamber and that is located below a back side of the index finger pocket 13.

In use, a player's hand is inserted into the hand-receiving chamber, and the player's index finger 2 (shown in phantom lines)-extends out of the glove body 10 via the through hole 12 so as to contact an outer surface of the back side panel 11. One of the reasons why the conventional baseball glove 1 is so constructed is to reduce the vibration that is transmitted to the index finger 2 during catching of a ball so that injury or pain to the index finger 2 can be minimized. This is made possible since the leather-made glove body 10 has good shock-absorption characteristics, and the index finger 2 can rely on both the palm side panel and the back side panel 11 of the glove body 10 for cushioning against the impact force of the ball during catching of the same. If the index finger 2 is disposed inside the glove body 10, the impact force is only minimally absorbed by the palm side panel of the glove body 10 before being transferred to the index finger 2. This often results in injury or pain to the index finger 2. Another reason why the conventional baseball glove 1 is so structured is to permit air to circulate within the glove body 10 so that sweating of the player's hand can be reduced.

However, since the outer surface of the back side panel 11 is smooth, the index finger 2 slips easily and cannot be retained comfortably on the back side panel 11 of the glove body 10.

SUMMARY OF THE INVENTION

Therefore, the object of the present invention is to provide a baseball glove that can limit movement of the index finger of a player at a back side panel of a glove body of the baseball glove after the index finger extends out of the glove body.

According to this invention, a baseball glove comprises a glove body and a finger-limiting rib unit. The glove body has a palm side panel and a back side panel which are interconnected to form a hand-receiving pocket that includes finger sections. The back side panel has a through hole below one of the finger sections, and a lacing provided along a periphery of the through hole. The through hole is adapted for extension of a player's index finger therethrough so as to dispose the index finger out of the glove body. The finger-limiting rib unit projects from the back side panel, and surrounds the lacing in a spaced apart relationship. The finger-limiting rib unit has a limiting portion disposed above the lacing and adapted to prevent the player's index finger from slipping on the back side panel.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
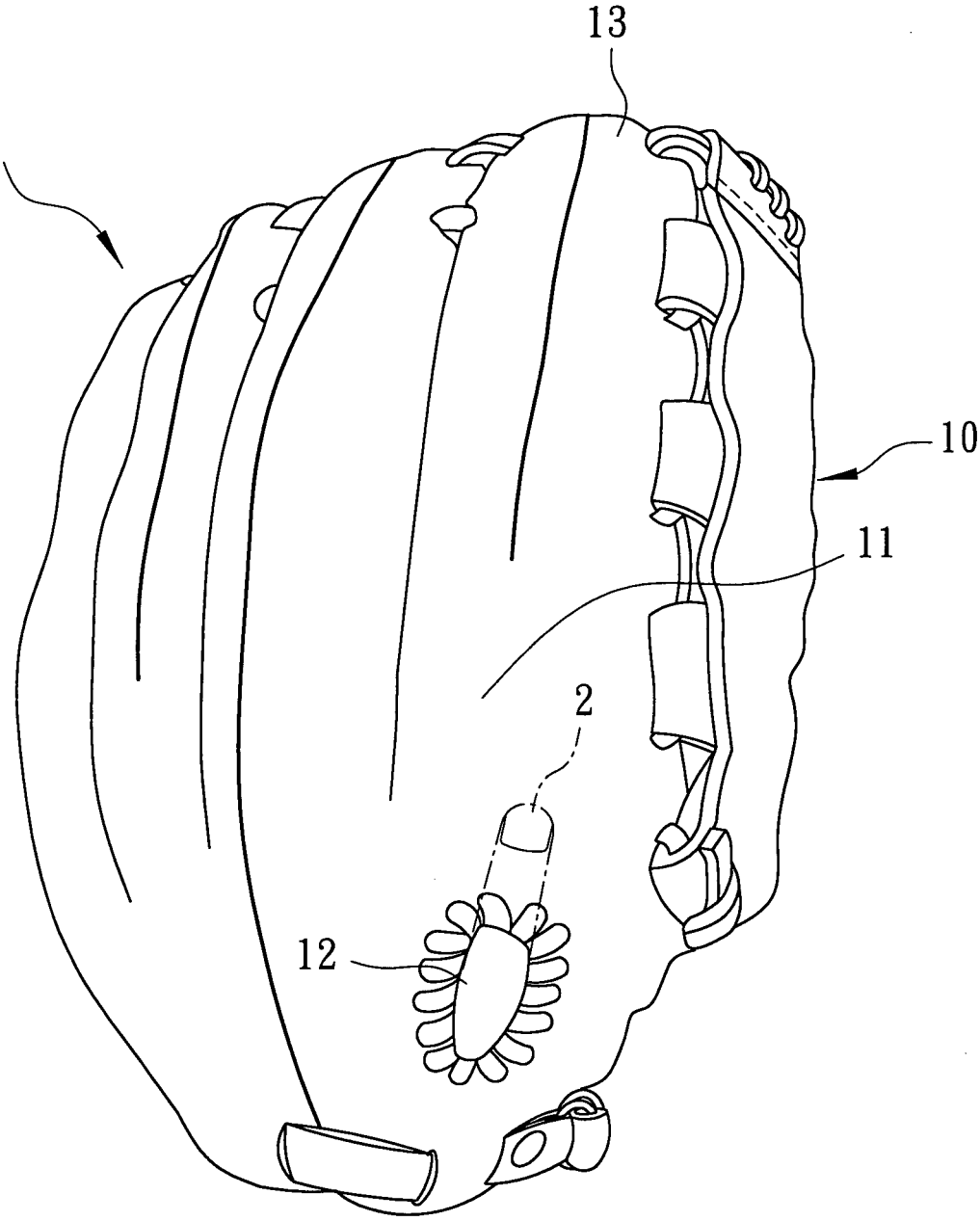
FIG. 1 PRIOR ART
FIG. 1 is a schematic rear view of a conventional baseball glove.

Before the present invention is described in greater detail, it should be noted that like elements are denoted by the same reference numerals throughout the disclosure.

Figure 2:
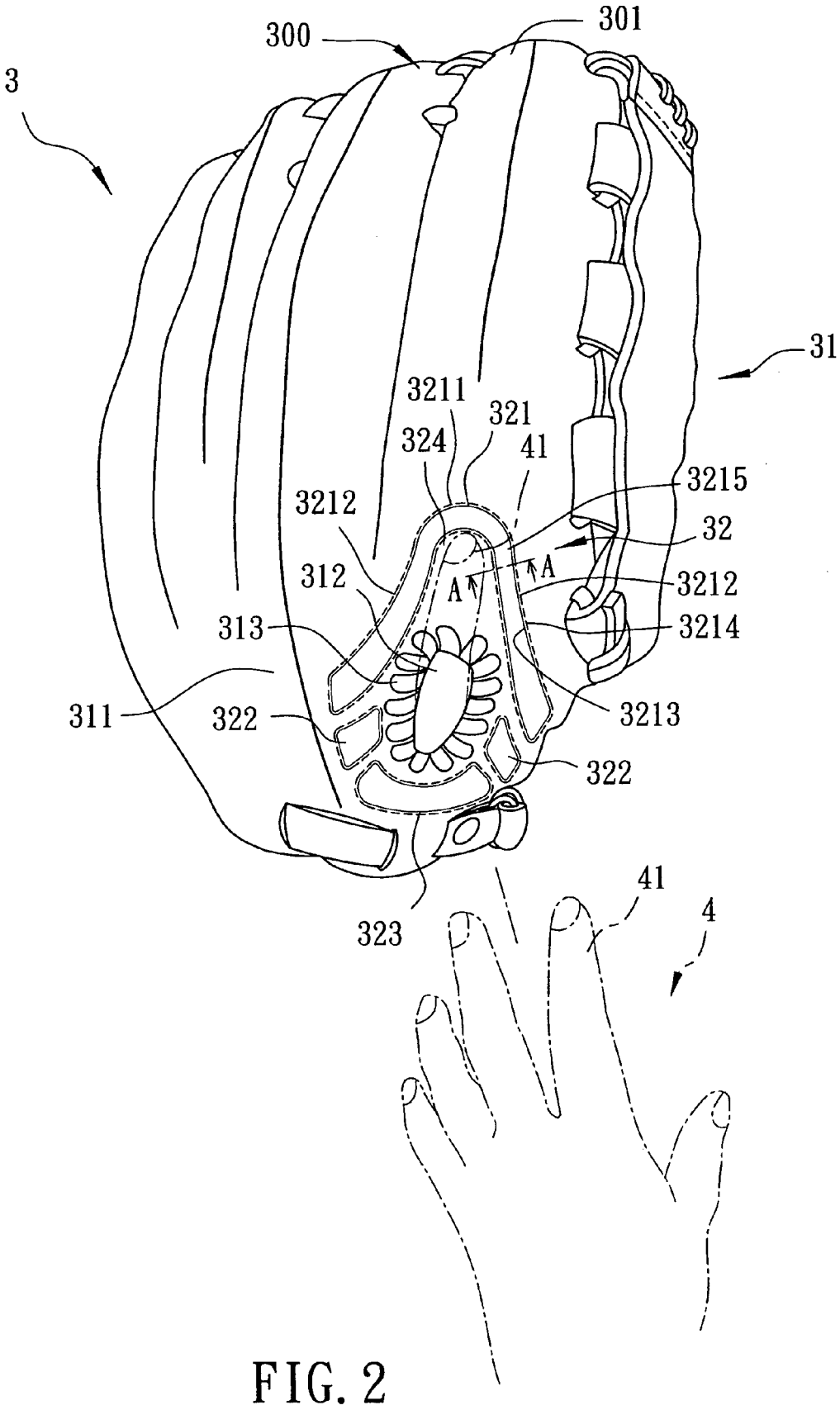
FIG. 2 is a schematic rear view of the first preferred embodiment of a baseball glove according to the present invention.
Figure 2A:
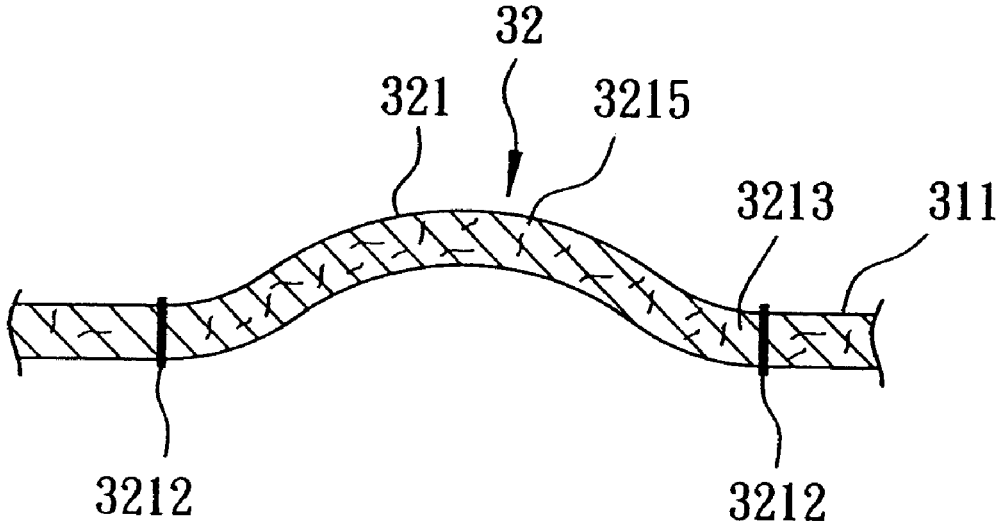
FIG. 2A is a partial sectional view and is taken on line A-A of FIG. 2.

Referring to FIG. 2, the first preferred embodiment of a baseball glove 3 according to the present invention is shown to comprise a glove body 31 and a finger-limiting rib unit 32.

The glove body 31 is made of a leather material, and has a palm side panel (not visible) and a back side panel 311 which are interconnected to form a hand-receiving pocket (not visible). The hand-receiving pocket is adapted for insertion of a player's hand 4 (shown in phantom lines) therein, and has finger sections 300. The finger sections 300 include an index finger section 301. The back side panel 311 has a through hole 312 below the index finger section 301 and communicating with the hand-receiving pocket, and a lacing 313 provided along a periphery of the through hole 312. The through hole 312 is adapted for extension of a player's index finger 41 (shown in phantom lines) therethrough so as to dispose the index finger 41 out of the glove body 31.

The finger-limiting rib unit 32 projects from the back side panel 311 of the glove body 31, and surrounds the lacing 313 in a spaced apart relationship. The finger-limiting rib unit 32 includes a first limiting rib 321, two second limiting ribs 322, a third limiting rib 323, and a limiting portion 324. The first limiting rib 321 has a substantially inverted-U shaped curved top end 3211, and two opposite arms 3212 extending downwardly and respectively from two opposite ends of the curved top end 3211 to two opposite sides of the through hole 312. The second limiting ribs 322 are disposed respectively below the two opposite arms 3212 of the first limiting rib 321. The third limiting rib 323 extends between the second limiting ribs 322 below the through hole 312. The limiting portion 324 is defined by the first limiting rib 321, and is disposed above the lacing 313.

In this embodiment, the first limiting rib 321 has an elongated embossment 3215 protruding from the back side panel 311 of the glove body 31, and a peripheral root 3213 that is connected to the embossment 3215 and that does not protrude from the back side panel 311. The first limiting rib 321 is made by embossing a leather piece using a die, after which the peripheral root 3213 is sewn so as to form a stitching line 3214 that is looped along the peripheral root 3213 and to fix the shape of the first limiting rib 321. The stitching line 3214 can prevent an external force from flattening the first limiting rib 321. The second and third limiting ribs 322, 323 are made in a manner similar to that of the first limiting rib 321, so that a detailed description of the same is dispensed herewith for the sake of brevity. The leather piece is then made to form the back side panel 311 of the glove body 31. Finally, the back side panel 311 and the palm side panel are sewn together in a conventional manner to form the baseball glove 3.

In use, the player's hand 4 is inserted into the glove body 31, i.e., into the hand-receiving pocket, and the player's index finger 41 is extended out of the glove body 31 via the through hole 312. The index finger 41 is received and retained in the limiting portion 324, and is prevented from slipping on the back side panel 311 of the glove body 31. Hence, the index finger 41 can rest comfortably on the back side panel 311 without experiencing any slipping. Further, the impact force of the ball transmitted to the index finger 41 during catching of the ball is reduced. Moreover, air is permitted to circulate within the glove body 31 via the through hole 312.

The provision of the second and third limiting ribs 322, 323 on the back side panel 311 of the glove body 31 not only can strengthen the structure of the glove body 31, but can also provide protection to the index finger 41. Further, the appearance of the glove body 31 is enhanced through the presence of the first to third limiting ribs 321, 322, 323 on the back side panel 311 of the glove body 31.

Figure 3:
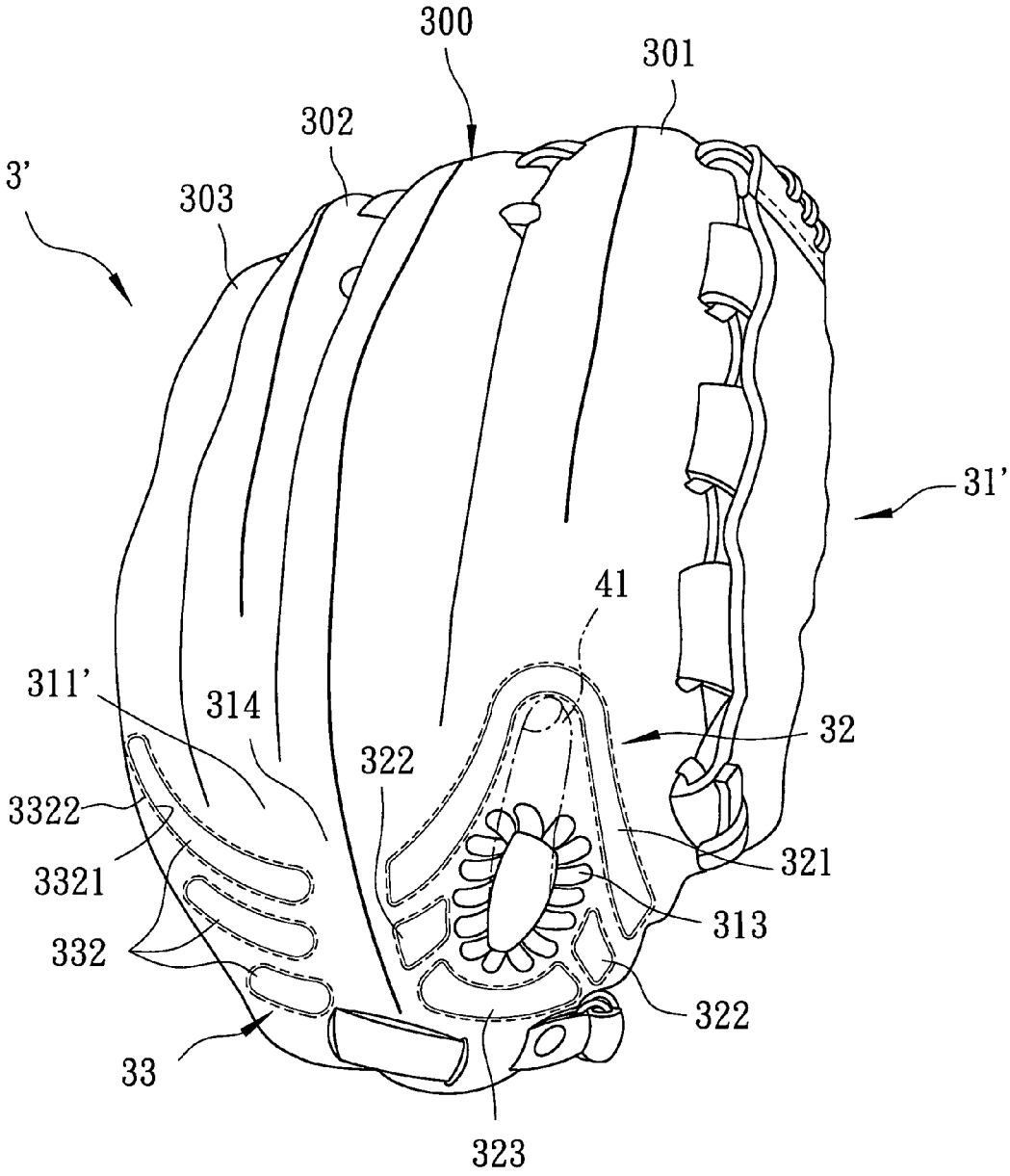
FIG. 3 is a schematic rear view of the second preferred embodiment of a baseball glove according to the present invention.
Figure 4:
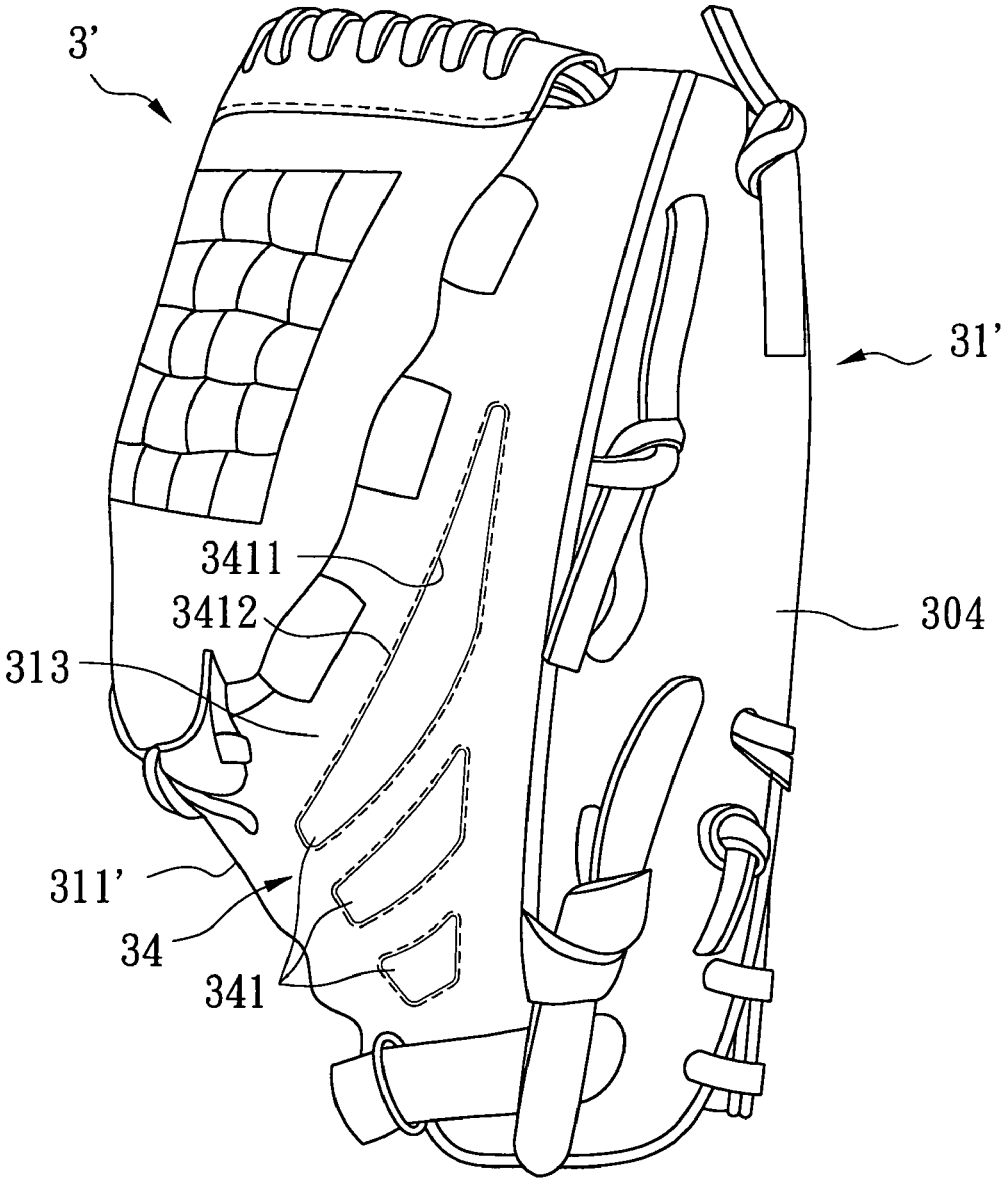
FIG. 4 is a schematic side view of the second preferred embodiment.

Referring to FIGS. 3 and 4, the second preferred embodiment of a baseball glove 3' according to the present invention is shown to be similar to the first preferred embodiment. However, in this embodiment, the baseball glove 3' further comprises a first reinforcing rib unit 33 and a second reinforcing rib unit 34. The finger sections 300 further include a little finger section 303, a ring finger section 302, and a thumb section 304. The back side panel 311' of the glove body 31' has a first back surface region 314 below the little and ring finger sections 303, 302, and a second back surface region 313 on a back side of the thumb section 304. The first reinforcing rib unit 33 is provided on the first back surface region 314, and has three spaced-apart first back ribs 332 (see FIG. 3). The second reinforcing rib unit 34 is provided on the second back surface region 313, and has three spaced-apart second back ribs 341 (see FIG. 4). Each of the first and second back ribs 332, 341 is made in a manner similar to that of the finger-limiting rib unit 32, that is, a leather piece is embossed using a die, after which a peripheral root 3321, 3411 of each back rib 332, 341 is sewn to provide a stitching line 3322, 3412 that is looped along the peripheral root 3321, 3411 of the corresponding back rib 332, 341, thereby fixing the shape of each back rib 332, 341.

Through the presence of the first and second back ribs 332, 341, i.e., the first back ribs 332 projecting outwardly from the first back surface region 314 and the second back ribs 341 projecting outwardly from the second back surface region 313, the back side panel 311' of the glove body 31' is strengthened and protected. Further, the overall appearance of the baseball glove 3' is enhanced due to the presence of the first and second back ribs 332, 341 and the first to third limiting ribs 321, 322, 323. Through such presence of the first to third limiting ribs 321, 322, 323, the advantages of the first preferred embodiment can be attained using the second preferred embodiment.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A baseball glove comprising:

a glove body having a palm side panel and a back side panel which are interconnected to form a hand-receiving pocket that has finger sections, said finger sections including an index finger section, said back side panel having a through hole below said index finger section, and a lacing provided along a periphery of said through hole, said through hole being adapted for extension of a player's index finger therethrough so as to dispose the index finger out of said glove body; and a finger-limiting rib unit projecting from said back side panel and surrounding said lacing in a spaced-apart relationship, said finger-limiting rib unit having a limiting portion disposed above said lacing and adapted to prevent the player's index finger from slipping on said back side panel;

wherein said finger-limiting rib unit includes a first limiting rib that has a substantially inverted-U shaped curved top end defining said limiting portion, and two opposite arms extending downwardly and respectively from two opposite ends of said curved top end to two opposite sides of said through hole;

wherein said finger-limiting rib unit further includes two second limiting ribs disposed respectively below said two opposite arms of said first limiting rib.

2. The baseball glove of claim 1, wherein said first limiting rib has an elongated embossment protruding from said back side panel and a root that is connected to said embossment and that does not protrude from said back side panel, said back side panel further having a stitching line looping along said root.

3. The baseball glove of claim 1, wherein said finger-limiting rib unit further includes a third limiting rib extending between said second limiting ribs below said through hole.

4. The baseball glove of claim 1, further comprising a first reinforcing rib unit, said finger sections including a ring finger section and a little finger section, said back side panel having a first back surface region below said little finger section and said ring finger section, said first reinforcing rib unit being provided on said first back surface region.

5. The baseball glove of claim 4, wherein said first reinforcing rib unit has a plurality of spaced-apart first back ribs provided on said first back surface region.

6. The baseball glove of claim 4, further comprising a second reinforcing rib unit, said finger sections further including a thumb section, said back side panel further having a second back surface region on a back side of said thumb section, said second reinforcing rib unit being provided on said second back surface region.

7. The baseball glove of claim 6, wherein said second reinforcing rib unit has a plurality of spaced-apart second back ribs provided on said second back surface region.

* * * * *